US009868621B2

(12) United States Patent
Jaipaul

(10) Patent No.: US 9,868,621 B2
(45) Date of Patent: Jan. 16, 2018

(54) COMBUSTION-POWERED LIFT SYSTEM

(71) Applicant: Gray Manufacturing Company, Inc., St. Joseph, MO (US)

(72) Inventor: Larry M. Jaipaul, Clarence, MO (US)

(73) Assignee: Gray Manufacturing Company, Inc., St. Joseph, MO (US)

( * ) Notice: Subject to any disclaimer, the term of this patent is extended or adjusted under 35 U.S.C. 154(b) by 401 days.

(21) Appl. No.: 14/622,435

(22) Filed: Feb. 13, 2015

(65) Prior Publication Data

US 2015/0232310 A1 Aug. 20, 2015

Related U.S. Application Data

(60) Provisional application No. 61/942,420, filed on Feb. 20, 2014.

(51) Int. Cl.
*B66F 5/04* (2006.01)
*B66F 3/46* (2006.01)

(52) U.S. Cl.
CPC ..... *B66F 3/46* (2013.01)

(58) Field of Classification Search
CPC ..... B66F 1/00; B66F 3/24; B66F 7/04; B66F 9/00; B66F 9/12
See application file for complete search history.

(56) References Cited

U.S. PATENT DOCUMENTS 4,277,312 A * 7/1981 McKenna ..... C10B 43/06 15/93.2
4,546,601 A * 10/1985 Skovhoj ..... A01B 45/00 172/311
5,575,607 A 11/1996 Grout et al.
5,836,398 A * 11/1998 White ..... A62C 27/00 169/24
7,865,286 B1 1/2011 Hall
8,360,443 B2 * 1/2013 Ellington ..... B62B 3/0612 187/224
2008/0173293 A1 * 7/2008 Baratta ..... B23D 59/025 125/15
2009/0020369 A1 * 1/2009 Warachka ..... B66F 9/12 187/231
2009/0041564 A1 * 2/2009 Borntrager ..... B66F 9/065 414/352
2009/0315003 A1 * 12/2009 Slagle ..... E02D 9/02 254/30
2010/0183412 A1 * 7/2010 Borntrager ..... B66F 9/065 414/541
2013/0283992 A1 * 10/2013 Belzile ..... B27B 13/00 83/813
2015/0232310 A1 * 8/2015 Jaipaul ..... B66F 3/46 414/800

FOREIGN PATENT DOCUMENTS

EP 1871641 B1 2/2011

* cited by examiner

*Primary Examiner* — Lee D Wilson
(74) *Attorney, Agent, or Firm* — Hovey Williams LLP

(57) ABSTRACT

A combustion-powered portable vehicle lift comprising a base, a post supported by the base, and a carriage assembly vertically shiftable relative to the post. The vehicle lift additionally comprises a combustion power system including a fuel tank and a combustion engine. The vehicle lift further comprises a hydraulic power system including a hydraulic reservoir, a hydraulic pump, and a hydraulic cylinder. As such, the combustion power system is operable to power the hydraulic power system to shift the carriage assembly relative to the post.

18 Claims, 6 Drawing Sheets

COMBUSTION-POWERED LIFT SYSTEM

RELATED APPLICATIONS

This non-provisional patent application claims priority to provisional patent applications U.S. Ser. No. 61/942,420 filed Feb. 20, 2014, and entitled "COMBUSTION-POWERED LIFT SYSTEM," the entire disclosure of which is herein incorporated by reference.

FIELD OF THE INVENTION

The present invention relates to a combustion-powered lift system and, more particularly, to a coordinated combustion-powered lift system capable of incorporating two or more lift mechanisms, so as to coordinate the raising and lowering of a vehicle.

BACKGROUND

The need to lift a vehicle from the ground for service work is well established. For instance, it is often necessary to lift a vehicle for tire rotation or replacement, steering alignment, oil changes, brake inspections, exhaust work, and other automotive service work. Traditionally, lifting a vehicle has been accomplished through the use of equipment that is built-into the service facility, such as either lift units with the hydraulic actuator(s) installed below the surface of the floor or two and four post-type lift systems installed on the floor surface.

In an effort to increase the versatility and mobility of lift devices and to reduce the need to invest in permanently mounted lifting equipment, devices commonly known as a mobile column lifts (MCL's) have been developed. An apparatus for lifting a vehicle using multiple MCL's is described in U.S. Pat. No. 6,315,079 to Berends et al. Another apparatus for lifting a vehicle using multiple MCL's is described in U.S. Pat. No. 6,634,461, the entire disclosures of both patents are incorporated herein by reference. Notably, the device disclosed in '461 Patent includes multiple MCL's that are powered by rechargeable batteries within each lift unit.

As indicated above, prior MCL systems generally utilize electrically-powered hydraulic lifting systems that require battery technology, which limits the number of lift cycles that can be achieved before battery recharging is necessary. Furthermore, those electrically-powered hydraulic lifting systems that utilize AC mains power sources (i.e., AC power outlets) are limited in mobility and are subject to unexpected and lengthy power outages. Such limitations reduce productivity and inconvenience operators. By using alternative power sources, such as combustion engines, these limitations can be greatly reduced if not eliminated. Because propane is readily available in portable vessels and has a nearly infinite shelf life, refueling a lift utilizing a propane power system can be efficiently accomplished. Furthermore, hydraulic lifts powered by combustion power sources can realize significant increases in lifting capabilities and efficiencies over traditionally-used, electrically-powered hydraulic lifts.

Accordingly, there remains a need for a combustion-powered mobile lift system that permits users to perform remote lifting operations without the need for batteries or other electrically-based power sources.

SUMMARY

One embodiment of the present invention broadly includes a combustion-powered portable vehicle lift comprising a base, a post supported by the base, and a carriage assembly vertically shiftable relative to the post. The vehicle lift additionally comprises a combustion power system including a fuel tank and a combustion engine. The vehicle lift further comprises a hydraulic power system including a hydraulic reservoir, a hydraulic pump, and a hydraulic cylinder. As such, the combustion power system is operable to power the hydraulic power system so as to shift the carriage assembly relative to the post.

Another embodiment of the present invention broadly includes a portable vehicle lift system comprising two or more portable lifts, with each lift including a base, a post, and a carriage assembly. Each of the portable lifts further includes a combustion power system comprising a dedicated fuel tank and a combustion engine, as well as a hydraulic power system comprising a hydraulic reservoir, a hydraulic pump, and a hydraulic cylinder. The combustion power system is operable to provide power to the hydraulic power system to shift the carriage assembly relative to the post.

An additional embodiment of the present invention includes a method for using a combustion-powered portable vehicle lift system to raise a vehicle. The method comprises the initial step of providing two or more portable lifts, each comprising a carriage assembly configured to engage and support a wheel of the vehicle, a hydraulic power system with a hydraulic cylinder configured to vertically shift the carriage assembly, a combustion engine for powering the hydraulic power system, and an electrical control system configured to control the portable lifts. An additional step includes providing an instruction to the lift system to raise the vehicle. A next step includes determining whether the combustion engine associated with each of said two or more portable lifts is running Upon determining that each combustion engine is running, a next step includes raising the vehicle with the portable lifts of the lift system. Furthermore, upon determining that each combustion engine is not running, an additional step includes not raising the vehicle.

This summary is provided to introduce a selection of concepts in a simplified form that are further described below in the detailed description below. This summary is not intended to identify key features or essential features of the claimed subject matter, nor is it intended to be used to limit the scope of the claimed subject matter. Other aspects and advantages of the present invention will be apparent from the following detailed description of the embodiments and the accompanying drawing figures.

BRIEF DESCRIPTION OF THE DRAWING FIGURES

Embodiments of the present technology are described in detail below with reference to the attached drawing figures, wherein.

Figure 2:
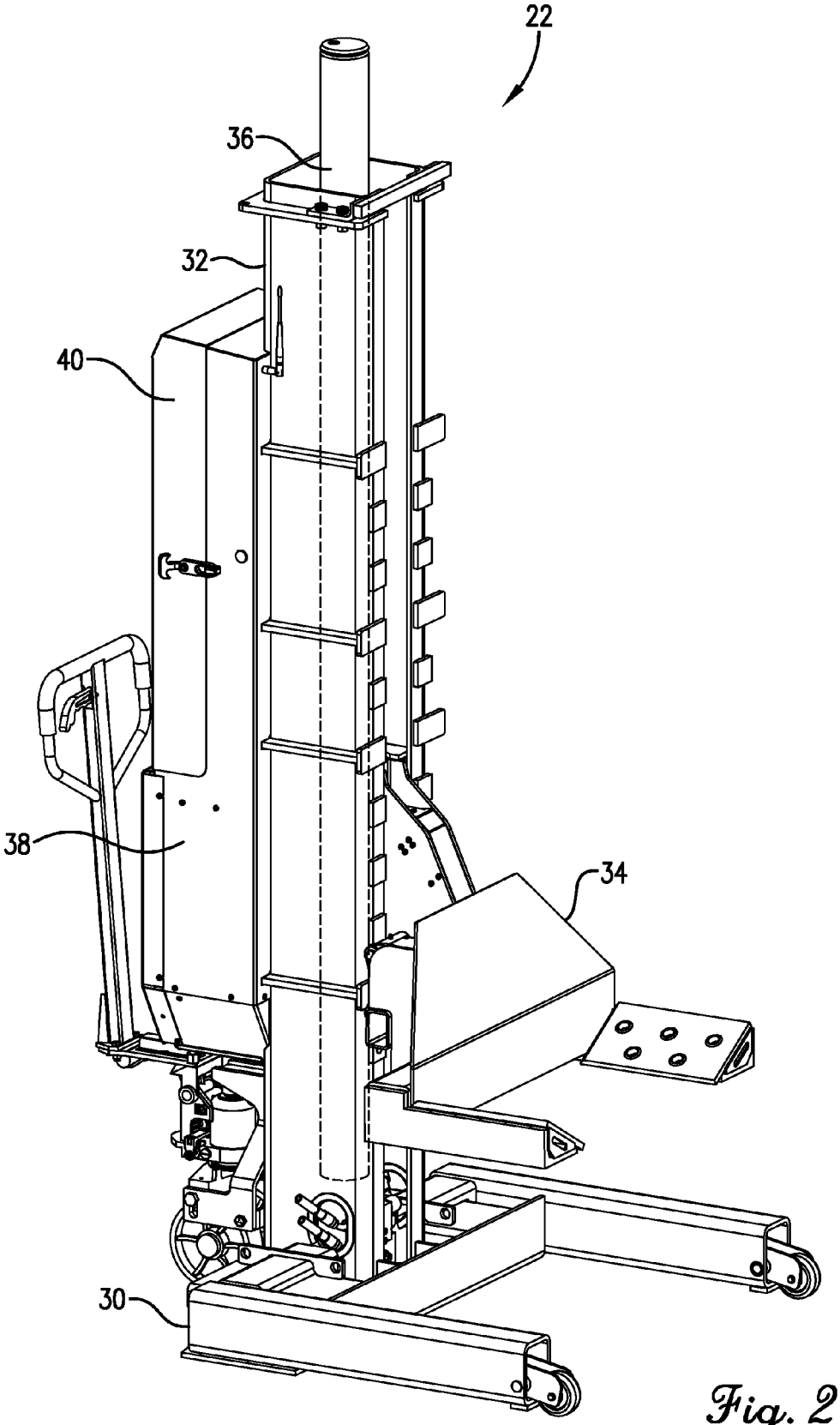
FIG. 2 is a perspective view showing the front and side of a portable lift configured in accordance with certain embodiments of the present invention.
Figure 3A:
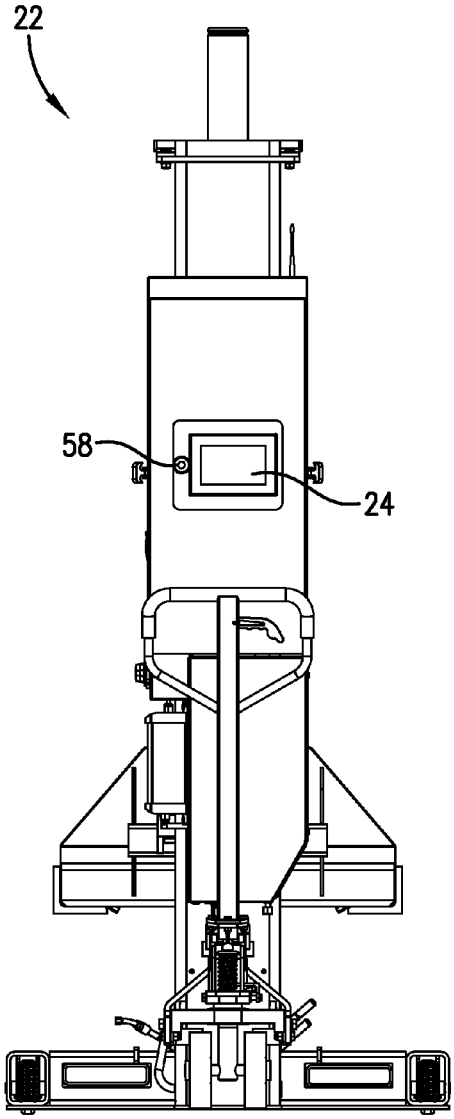
Figure 3B:
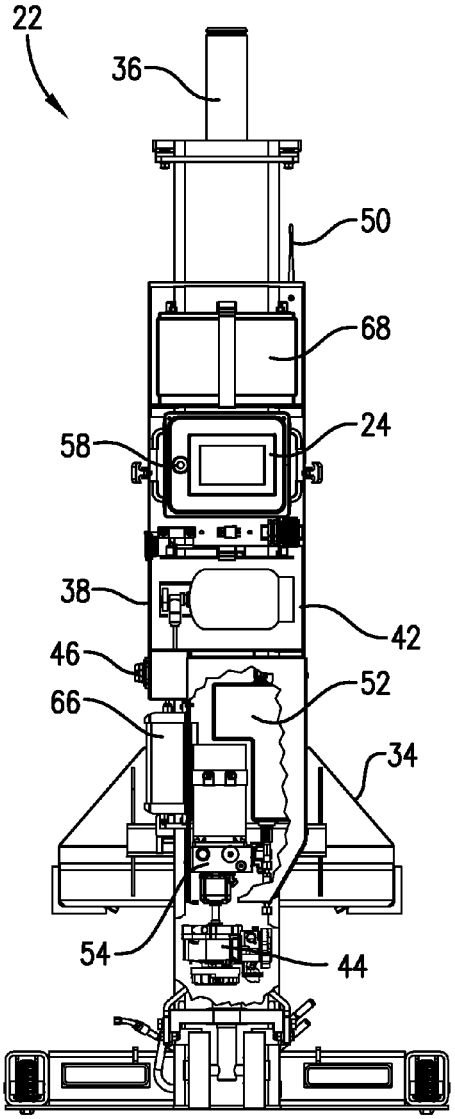

FIG. 3*a* a rear elevation view of the portable lift of FIG. 2;

FIG. 3*b* is a rear elevation view of the portable lift of FIG. 2, with an access panel being removed to show certain internal components located in an upper portion of a main housing of the lift, and a lower portion of the main housing cut away to show certain internal components located in a lower portion of the main housing of the lift.

Figure 4:
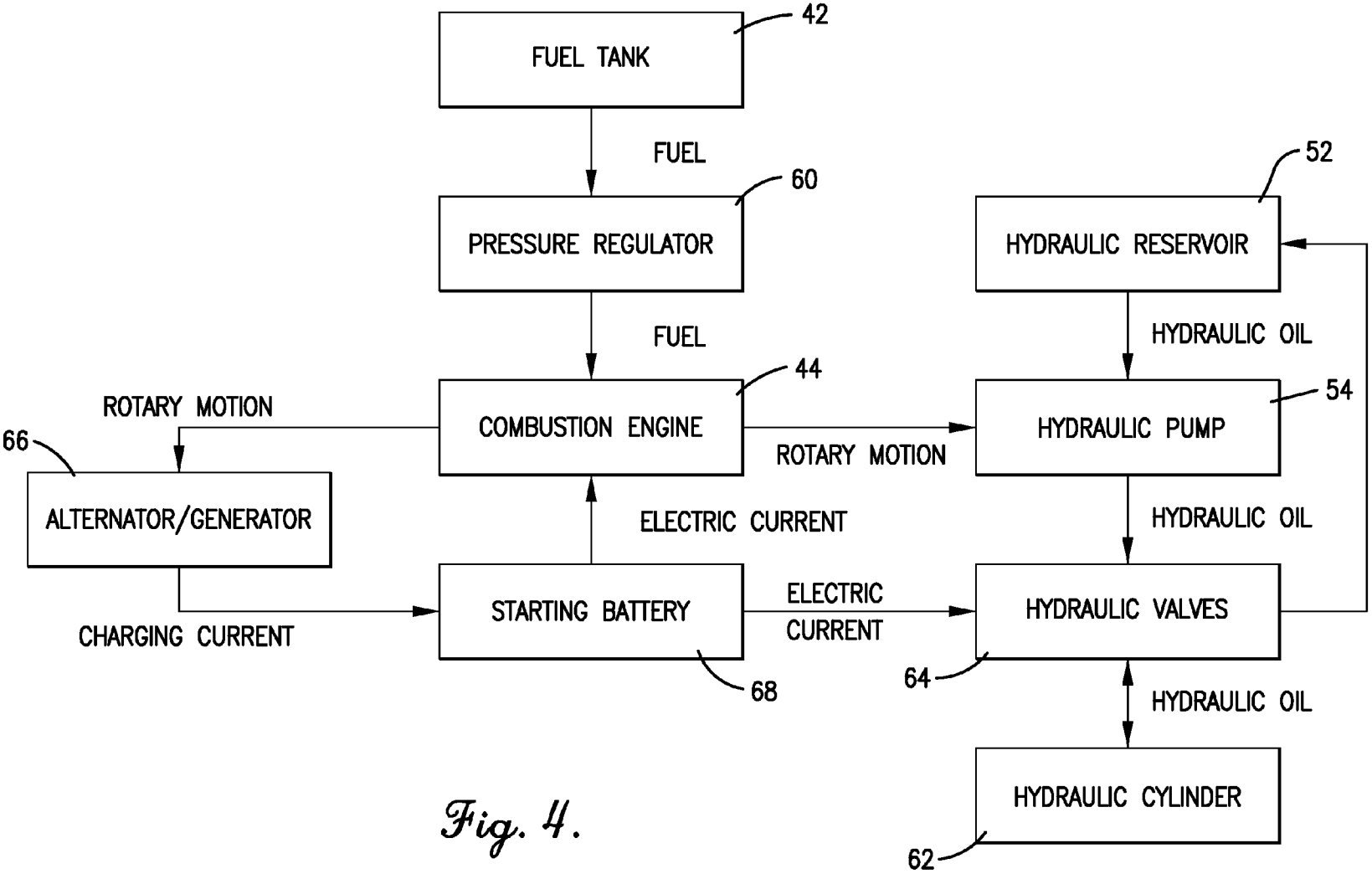
Figure 5:
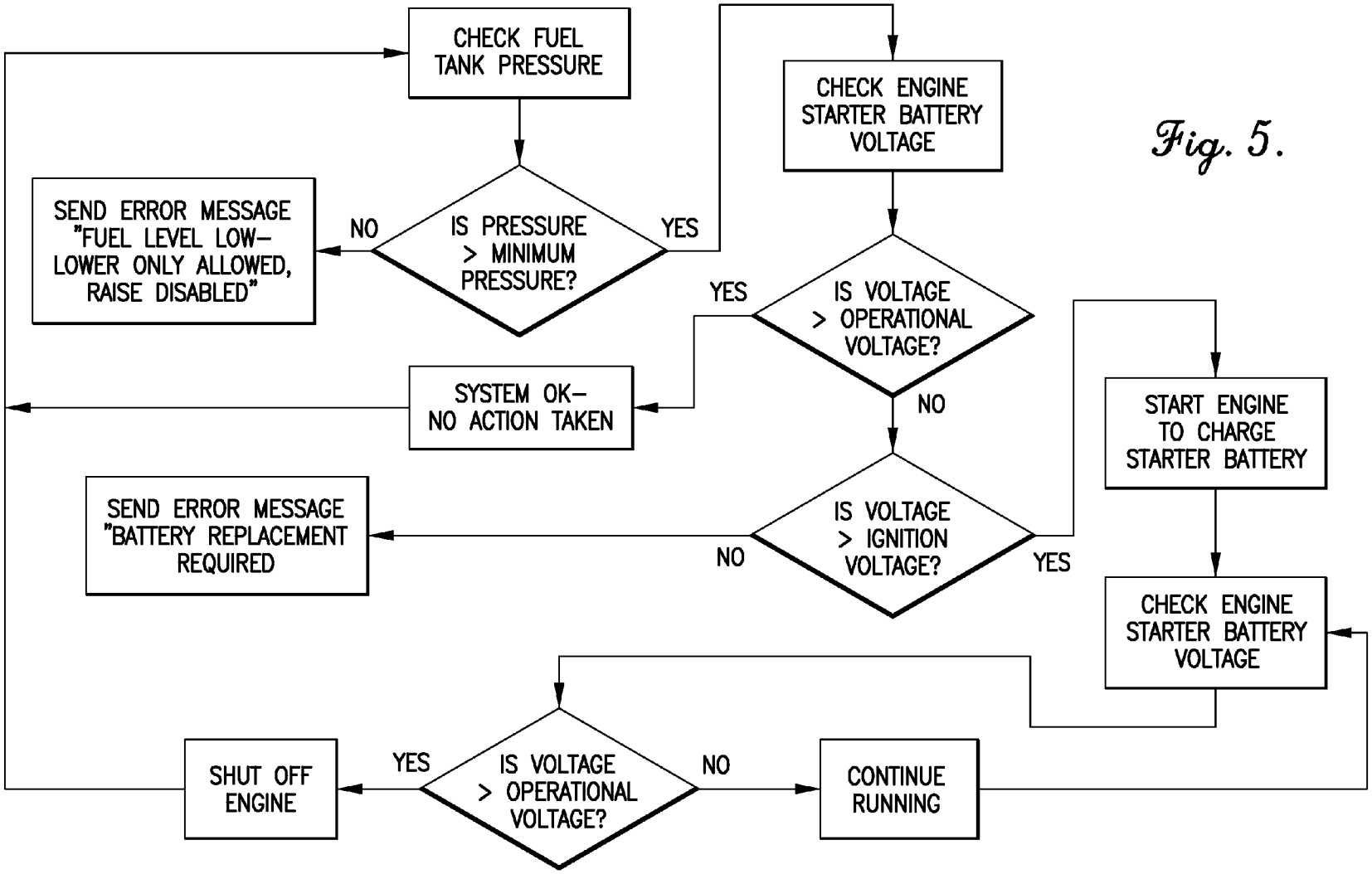
Figure 6:
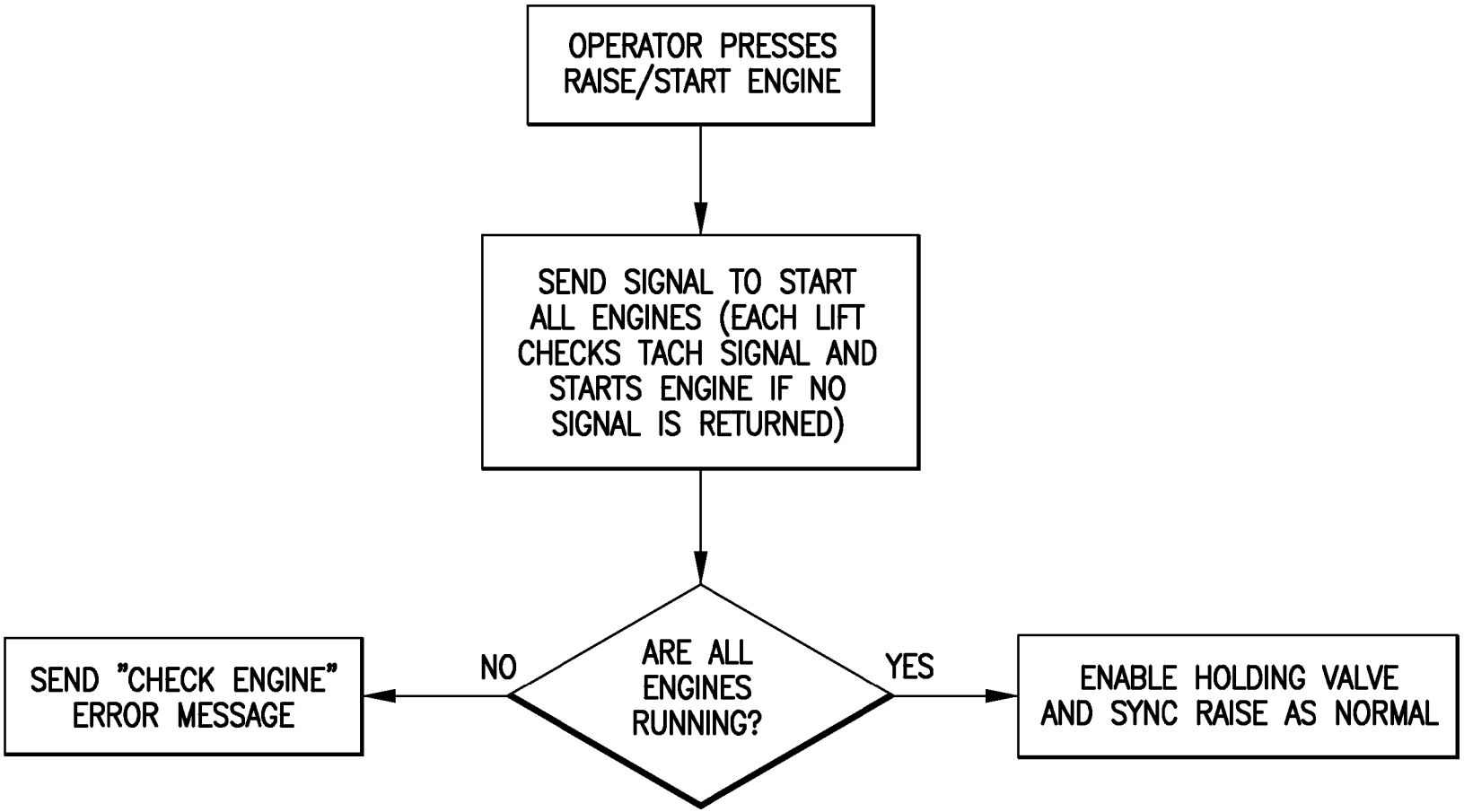

FIG. 4 is a schematic representation of a combustion power system and a hydraulic power system operating as part of a portable vehicle lift according to embodiments of the present invention;

FIG. 5 is a flow chart illustrating a method for maintaining a combustion-powered portable vehicle lift in an operational condition according to embodiments of the present invention; and FIG. 6 is a flow chart illustrating a method for raising a vehicle with combustion-powered portable vehicle lifts of a lifts system according to embodiments of the present invention.

The drawing figures do not limit the present invention to the specific embodiments disclosed and described herein. The drawings are not necessarily to scale, emphasis instead being placed upon clearly illustrating the principles of the technology.

DETAILED DESCRIPTION

The following detailed description of various embodiments of the present technology references the accompanying drawings which illustrate specific embodiments in which the technology can be practiced. The embodiments are intended to describe aspects of the technology in sufficient detail to enable those skilled in the art to practice them. Other embodiments can be utilized and changes can be made without departing from the scope of the technology. The following detailed description is, therefore, not to be taken in a limiting sense. The scope of the present technology is defined only by the appended claims, along with the full scope of equivalents to which such claims are entitled.

Note that in this description, references to "one embodiment" or "an embodiment" mean that the feature being referred to is included in at least one embodiment of the present invention. Further, separate references to "one embodiment" or "an embodiment" in this description do not necessarily refer to the same embodiment; however, such embodiments are also not mutually exclusive unless so stated, and except as will be readily apparent to those skilled in the art from the description. For example, a feature, structure, act, etc. described in one embodiment may also be included in other embodiments. Thus, the present invention can include a variety of combinations and/or integrations of the embodiments described herein.

Figure 1:
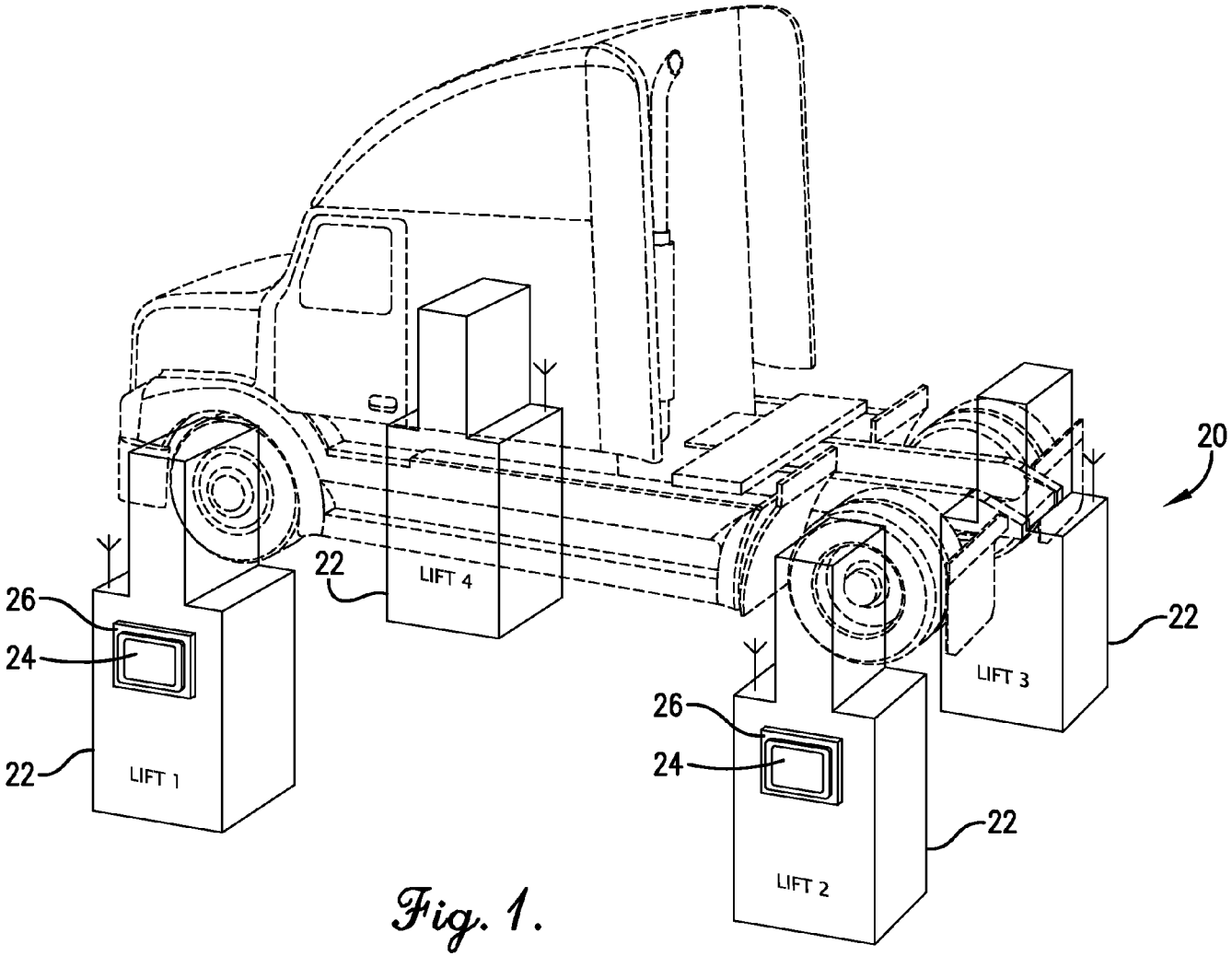
FIG. 1 is a simplified representation of a portable lift system utilizing four individual lifts to perform a coordinated lift of a vehicle, where one or more of the lifts is equipped with a user interface.

Referring now to the drawings, and initially to FIG. 1, numeral 20 generally designates a portable vehicle lift system having four individual, portable lifts 22. This vehicle lift system 20 may be similar, in certain respects, to the vehicle lift system described in U.S. Patent App. Publ. No. 2013/0240300, which is incorporated by reference herein in its entirety. Distinguishingly, the portable vehicle lift system 20 of the present invention is at least partially powered by combustion. Returning to the drawings of the present application, although FIG. 1 depicts a four lift system 20, it should be understood that any combination of two or more lifts 22 can be used. For example, the lift system 20 can employ two, four, six, eight, or generally any number of individual lifts 22. In certain embodiments, each of the lifts 22 may be substantially identical. It should also be understood that lift system 20 is not limited for use with vehicles, but also may be used to raise or lower other objects relative to a floor or ground surface, such as aircraft, industrial machinery, shipping containers, construction subassemblies, and the like.

The portable vehicle lift system 20 depicted in FIG. 1 may be equipped with a combustion power system that provides mechanical power to multiple components of the lifts 22 of the vehicle lift system 20. Additionally, the vehicle lift system 20 may include an electrical control system that controls the operation of the lifts 22 in response to operator commands. The electrical control system can include a wireless communication system that wirelessly communicates lift control signals to, from, and/or among the lifts 22. Furthermore, the vehicle lift system 20 may comprise a hydraulic power system that provides hydraulic power for performs the raising and/or lowering operations of the lifts 22.

As shown in FIG. 1, of the individual lifts 22 of the lift system 20 can be equipped with a user interface 24 that, after initial set-up of the lift system 20, permits the entire lift system 20 to be controlled via one of such user interfaces 24. The user interface 24 can include a touch screen display that enables enhanced operating features of the lift system 20. For example, when the user interface 24 includes a touch screen display, the touch screen display can be programmed to display a real time animation of the lift positions and/or the vehicle position as the vehicle is raised and/or lowered by the lift system 20 via the lifts 22. In some embodiments, the user interfaces 24 may be detachable from their respective lifts 22, via a docking station 26, such that the user interfaces 24 may be utilized remotely to control the lifts 22.

Turning now to FIGS. 2, 3*a*, and 3*b*, a wireless portable lift 22 configured in accordance with one embodiment of the present invention is further illustrated. The lift 22 can include a base 30, a post 32, a carriage assembly 34, a lift actuator 36, and a main housing 38. The base 30 supports the lift on the floor or the ground. The post 32 is rigidly coupled to the base 30 and extends upwardly therefrom. The carriage assembly 34 is configured to engage the wheel of a vehicle and is vertically shiftable relative to the post 32. The lift actuator 36 is received in the post 32 and is operable to vertically raise and lower the carriage assembly 34 relative to the post 32 and the base 30. The main housing 38 is attached to the post 32 and encloses many of the components of that make up the combustion power system, the electrical control system, and the hydraulic power system of the lift 22. The main housing 38 includes a removable access panel 40 for providing access to various components of the combustion power system, the electrical control system, and the hydraulic power system. In some embodiments, certain components of the combustion power system, the electrical control system, and the hydraulic power system will be located outside of the main housing 38.

FIG. 3*b* provides a rear view of the lift 22 with the access panel 40 being removed to show certain internal components located in an upper portion of the main housing 38. In FIG. 3*b*, a lower portion of the main housing 38 is also cut away to show certain internal components located in the lower portion of the main housing 38.

As such, the lift 22 broadly includes the combustion power system, the electrical control system, and the hydraulic power system. More specifically, FIG. 3*b* shows that the combustion power system of the lift 22 can include a fuel tank 42, a combustion-powered engine 44, and one or more fuel lines and velocity fuses fluidly connecting the fuel tank 42 with the combustion engine 44. The electrical control system of the lift 22 can include a main power switch 46, the user interface 24, an antenna 50, an emergency-stop switch 58, and various communication lines. Finally, the hydraulic power system of the lift 22 can include a hydraulic reservoir 52, a hydraulic pump 54, and various fluid valves and lines (not shown) for interconnecting the components of the hydraulic power system. Certain other components of the combustion power system, the electrical control system, and the hydraulic power system of the lift 22 are not shown in detail in FIG. 3*b*, but will be described in greater detail below.

FIG. 4 provides a simplified flow-chart of the operation of the combustion power system and the hydraulic power system for a portable lift 22 according to embodiments of the present invention. As illustrated in FIG. 4, each lift 22 can include the fuel tank 42 that supplies fuel, via a pressure regulator 60, to the combustion engine 44. It certain embodiments, it may preferable that the fuel used in operation of the lift 22 be propane. As such, the fuel tank 42 may be a propane tank, and the combustion engine 44 may be a propane engine. Nevertheless, it should be understood that the combustion-powered lifts of the present invention may be powered by other fuels, such as natural gas or hydrogen. In still further embodiments, other liquid fuels may be used, such as gasoline, diesel, biofuel, or the like.

Some embodiments of the present invention may include multiple fuel tanks 42 connected to each of the lifts 22, so as to increase the fuel availability for the combustion engine 44. For instance, when a first fuel tank 42 is empty, it can be immediately replaced with a second, full fuel tank 42. Still other embodiments of the present invention provide for the lifts system 20 to include a plurality of refillable fuel tanks 42. In such embodiments, the fuel tanks 42 will include all of the necessary connectors, adapters, and pressure regulators necessary for dispensing fuel from and for refilling the fuel tanks 42. Furthermore, the fuel tanks 42 can be of various sizes and have various fuel capacities. In some embodiments, such as when the fuel tank 42 comprises a propane tank, the fuel tank 42 may have a capacity ranging from of about 10 lbs.-33 lbs. Such a capacity may be preferable, for example, when the fuel tank 42 is integrated within the lift 22. In alternative embodiments, the fuel tank 42 capacity may range from about 30 lbs.-100 lbs. or more. Such capacities may be preferable, for example, when the fuel tank 42 is located exterior to the lift 22.

Remaining with FIG. 4, the combustion engine 44 may operate like any standard combustion engine known in the art, i.e., by generating rotary motion from the combustion of fuel. Such rotary motion is capable of providing power to the hydraulic power system of the lift 22. In more detail, the combustion engine 44 is operable to drive the hydraulic pump 54 of the hydraulic power system. In turn, the hydraulic pump 54 is capable of providing hydraulic fluid from the hydraulic reservoir 52 to a hydraulic cylinder 62, via one or more hydraulic valves 64. It should be understood that provision of hydraulic fluid to the hydraulic cylinder 62 will cause the hydraulic cylinder 62 to extend, while the removal of hydraulic fluid from the hydraulic cylinder 62 will cause the hydraulic cylinder to retract. Such extension and retraction actions of the hydraulic cylinder 62 will cause vertical movement of the lift actuator 36 of the lift 22. In some embodiments, the hydraulic cylinder 62 may be integrally formed with the lift actuator 36. Because the lift actuator 36 is coupled with the carriage assembly 34, vertical movement of the hydraulic cylinder 62 will therefore cause a corresponding vertical movement of the lift actuator 36 and the carriage assembly 34. If a vehicle is being supported by the carriage assembly 34, such vehicle will likewise be vertically moved. In certain embodiments, the hydraulic system will include the one or more hydraulic valves 64 for controlling the operation of the lift system 20, as will be discussed in more detail below.

As further shown in FIG. 4, the combustion engine 44 will, in certain embodiments provide rotary motion to an alternator 66 (i.e., a generator) for creating an electrical charging current that can be used to store electrical energy in a battery 68. In such embodiments, the battery 68 may be operable to act as an ignition source for the combustion engine 44. In some embodiments, electrical storage devices other than batteries, such as capacitors, super-capacitors, or the like may be used with the lift system 20. Once the combustion engine 44 has started and is running, the associated alternator 66 can be used to provide power to the various other components of the lift's 22 electrical control system (and also to the hydraulic valves 64) and to recharge the battery 68. In other embodiments, the electrical control system (and the hydraulic valves 64) will receive power directly from the battery 68. As such, the combustion power system, via the alternator 66, is operable to generate and maintain all of the electrical power requirements of the lift 22.

Because the combustion power system provides power to both the electrical control system and to portions of the hydraulic power system, it is important that the combustion engine 44 is continuously in an operable state (i.e., the engine is ready to be started and ran). As illustrated in FIG. 5, embodiments of the present invention include a process for determining whether the combustion power system is in an operable state. First, the electrical control system will monitor a pressure within the fuel tank 42 to determine whether there is sufficient fuel in the tank 42 for the combustion engine 44 to run for a given amount of time. In certain embodiments, such a given amount of time will be at least 2 hours, 6 hours, 12 hours, or 24 hours. The electrical control system will determine the pressure within the fuel tank via a pressure sensor associated with the fuel tank 42 and/or associated with the tank's 42 corresponding valves and/or lines. Should the fuel tank 42 pressure be below a given minimum pressure, such as below 10 p.s.i., 50 p.s.i., 100 p.s.i., or 200 p.s.i., or any pressure therebetween, an error message will be generated via the user interface 24 indicating a low fuel level and that the use of the lift 22 is restricted to lowering only (i.e., raising operations are not available).

Remaining with FIG. 5, should the tank pressure be above the minimum pressure, then embodiments of the present invention provide for the electrical control system to sense the voltage level (or any other electrical metric) of the battery 68 to determine whether the battery voltage level is above an operational voltage level. The electrical control system may measure the voltage of the battery 68 through a voltmeter, or other electrical sensing mechanism, that is associated with the battery 68 or otherwise with the lift 22. As an illustrative example, the battery 68 may have an operational voltage level of 12.4 volts. As such, voltage levels above 12.4 volts are considered operational. A certain range of voltage levels below the operational may be considered non-ideal, but will still be high enough to provide ignition to the combustion engine 44. For example, a battery voltage level of between 9.8 volts and 12.3 volts may provide enough voltage to ignite the combustion engine 44, even though such voltage levels are not ideal for operational purposes. However, any battery voltage levels below 9.8 volts will not allow the combustion engine 44 to be ignited. As such, should the battery voltage level be below the operational voltage level, the electrical control system will cause the combustion engine 44 to start, such that the engine 44 can operate the alternator 66 so as to re-charge the battery 68. While the battery 68 is recharging, the electrical control system will periodically test the battery 68 voltage level so as determine when the battery 68 has been re-charged to its operational voltage level (or charged to a certain level above the operational voltage level). If the battery 68 has been charged to the operational voltage level, then the electrical control system will cause the combustion engine 44 to turn off. If the battery 68 voltage level is still below the operational voltage level, then the combustion engine 44 will continue running such that the alternator 66 will continue to charge the battery 68. Should the battery voltage level fall below the operational voltage level necessary to provide ignition to the combustion engine 44, then the electrical control system will generate an error message via the user interface 24 indicating that the battery 68 needs to be externally recharged or replaced.

In some embodiments, the lifts 22 will include electrical outlets for use by accessories tools that may be required by the operators of the lifts 22. For example, in some embodiments, the electrical outlet will be a standard 120 VAC outlet that is operable to power accessory tools, such as lights, vacuums, air-compressors, electric wrenches, or the like. In other embodiments, the electrical outlets will also include a DC outlet, which may be capable of outputting varying levels of DC voltages and/or currents. Regardless of the type of electrical outlet, embodiments provide for the outlet to receive power from the alternator 66 or from the battery 68 (through one or more converters, rectifiers, conditioners as may be required). In still other embodiments, the lifts 22 will include an internal air-compressor that is powered by the electrical control system, via the alternator 66 and/or battery 68 (if the air-compressor is electrically powered), or otherwise powered directly via the combustion engine 44 (if the air-compressor is mechanically powered). The air-compressor may be used to provide pneumatic power for pneumatic tools, such as impact wrenches, air ratchets, sand blasters, paint sprayers, pneumatic drills, or the like.

Embodiments of the present invention provide for the electrical control system to control the lift's 22 hydraulic power system, via the one or more hydraulic valves 64. In certain embodiments, the hydraulic power system will include three hydraulic valves 64, including: a pump valve, a lowering valve, and a holding valve. In some embodiments, the valves 64 will be associated with solenoids that activate or deactivate their corresponding valves 64 in response to an electrical signals received by the electrical control system. As such, the hydraulic valves 64 are used to control the movement of the lift's 22 carriage assembly 34 relative to post 32 by controlling hydraulic fluid being applied to the hydraulic cylinder 62. In particular, with the pump valve in an open position, the hydraulic pump 54 is operable to move fluid from the hydraulic reservoir 52 to the hydraulic cylinder 62, so as to cause the hydraulic cylinder 62 to rise and/or extend. Contrastingly, when the lowering valve is activated, hydraulic fluid is released from the hydraulic cylinder 62 to thereby lower and/or retract the hydraulic cylinder 62 toward the surface under the influence of gravity. Finally, the holding valve is operable to generally maintain the position of the hydraulic cylinder 62 in a static position. The holding valve can be shiftable between a powering configuration and a recirculating configuration. When the holding valve is in the powering configuration, the holding valve routes hydraulic fluid from the hydraulic pump 54 to the hydraulic cylinder 62 for use in raising the carriage assembly 34. When the holding valve is in the recirculating configuration, the holding valve routes (recirculates) hydraulic fluid from the hydraulic pump 54 back to the hydraulic reservoir 52, thus bypassing the hydraulic cylinder 62 and causing the carriage assembly 34 to maintain a static position.

In certain embodiments, the holding valve may be biased toward the recirculating configuration and is only shifted into the powering configuration when electrical power is supplied to the holding valve. As such, if electrical power is cut to the holding valve, the holding valve automatically shifts into the recirculating configuration. Once the holding valve is in the recirculating configuration, the hydraulic cylinder 62 cannot be used to raise the carriage assembly 34, even if the combustion engine 44 and the hydraulic pump 54 continue to run, because hydraulic fluid is diverted around the hydraulic cylinder 62 and back into the hydraulic reservoir 52.

In order to raise the carriage assembly 34 of a given lift 22, electrical power must be provided to the holding valve to shift the holding valve into the powering configuration. As previously described, such electrical power is either received from the battery 68, which is charged by the alternator 66, or received directly from the alternator 66. Because the alternator 66 and/or battery 68 receive power, either directly or indirectly, from the combustion engine 44, the combustion engine 44 of lift 22 will need to be started and running for the lift to be operable for raising operations. In some embodiments, the lift 22 will be operable for lowering operations without the combustion engine 44 if the battery 68 is sufficiently charged. Furthermore, in a lift system 20 that includes multiple lifts 22, each of the combustion engines 44 associated with each lift 22 will need to be started and in a running configuration before the lift system 20 is operable. Instructions to turn the combustion engines 44 on and to raise the carriage assemblies 34 of each lift 22 can be received via the touch screen display of any one or more of the lifts' 22 user interfaces 24. Upon receiving "Start Engine" and/or "Raise Carriage" instructions from the user interface 24, the electrical control system will communicate a start engine signal to all of the lifts 22 of the system 20. Next, the electrical control system will communicate a holding valve power-up signal to all the lifts 22 of the system 20. This holding valve power-up signal ensures that all the holding valves of all the lifts 22 are shifted into a powering configuration in order to raise the lifts 22.

Before the lifts 22 begin to raise their respective carriages, embodiments of the present invention provide for certain error-checking procedures to take place. As illustrated by FIG. 6, once an operator instructs the electrical control system, via the user interface 24, to start the combustion engine 44 (e.g., "Start Engine") and to raise the carriage assembly 34 (e.g., "Raise Carriage"), the lift 22 from which the instructions are received will send a signal to each of the other lifts 22 in the lift system 20 to start all of the combustion engines 44 associated with such lifts 22. Upon receiving instructions to start their respective combustion engine 44, the electrical control system of each lift 22 will sense whether their combustion engine 44 is already running In particular, such sensing may be accomplished by monitoring a tachometer signal of the combustion engine 44. If the combustion engine 44 is already running, no further action is required. If the combustion engine 44 is not running, the electrical control system will start the combustion engine 44. Thereafter, each of the lifts 22 will transmit a signal indicating whether their respective combustion engine 44 started normally and is currently running If each of the lifts 22 indicates that their respective combustion engine 44 is currently running, then each of the lifts 22 will enable their respective holding valve and synchronize the lifting process (as discussed in more detail below). If one or more of the lifts 22 indicate that their combustion engine 44 is not running, then the operator is provided with an error message (e.g., "Check Engine") so as to notify the operator that some maintenance or repair is required before lifting operations can take place. If one or more of the combustion engines 44 is not running, the holding valves of those lifts 22 whose combustion engines 44 are running will be left in the recirculating configuration, such that that those lifts 22 will remain in a static condition until the non-running lift 22 comes on line.

Certain embodiments of the present invention additionally provide for the hydraulic valves 64 to include a safety release valve, which is a backup mechanism that normally tasks upon the failure of the hydraulic control system to prevent the carriage assembly 34 from inadvertently falling downwardly toward the ground. During the normal lowering operation of a lift 22, both the holding valve and the safety release valve may be activated to release the carriage assembly 34 and allow the lift 22 to lower.

In certain embodiments of the present invention, each lift 22 will have the emergency stop switch 58 include thereon. When the emergency-stop switch 58 is actuated by an operator of the lift system 20, the electrical control system will send a signal to cut electrical power to the holding valve of the lift 22. In addition, when the emergency-stop switch 58 is actuated, the electrical control system of the lift 22 on which the emergency-stop 58 was actuated wirelessly transmits an emergency-stop signal for receipt by the other lifts 22 of the system 20. Once the emergency-stop signal is received by the other lifts 22, power is cut to the holding valves of all the lifts 22 of the system 20. It is understood that although the power is cut to the holding valves, the combustion engines 44 of the lifts 22 will continue to run, such that electrical power is continuously provided to the electrical control systems via the alternator 66 and/or battery 68.

In accordance with certain embodiments of the present invention, the hydraulic power system may include one or more features for enhancing performance and reliability of the hydraulic power system. For example, as shown in FIG. 3*b*, the hydraulic pump 54 may include a fluid inlet that connects with a fluid outlet of the hydraulic reservoir. Beneficially, the fluid inlet of the hydraulic pump 54 may be located below the hydraulic reservoir 52. This configuration can be advantageous because it facilitates a gravity-feed action of the hydraulic fluid from the hydraulic reservoir 52 to the hydraulic pump 54. This gravity-feed action provides improved energy efficiency over conventional portable lift systems because the hydraulic pump 54 of the present invention is not required to pump hydraulic fluid from the reservoir 52 every time the lift 22 is actuated. In addition, the hydraulic tank used as the hydraulic reservoir 52 can have an enhanced physical configuration. In certain embodiment the hydraulic reservoir 52 can be non-cylindrical, with substantially planar side walls. As illustrated in FIG. 3*b*, the hydraulic reservoir 52 may have a generally inverted L configuration, with the hydraulic pump 54 and/or dump valve being at least partly received in the gap presented by the inverted L.

As previously described, the lift actuator 36 may be moved relative to the main housing 38 of the lift 22 using the hydraulic cylinder 62. The hydraulic cylinder 62 may be engaged between the support frame of the lift 22, in such a way that extension and retraction of the hydraulic cylinder 62 moves the lift actuator 36 and the carriage assembly 34 upwardly or downwardly, resepectively. In more detail, the combustion engine 44 provides rotary power to the hydraulic pump 54, which in combination with the associated hydraulic valves 64, moves hydraulic fluid to the hydraulic cylinder 62 in such a manner as to cause the hydraulic cylinder 62 to extend. The extension of the hydraulic cylinder 62 causes movement of the lift actuator 36, which correspondingly causes the carriage assembly 34 to move upward relative to the ground surface. Contrastingly, as hydraulic fluid is removed from the hydraulic cylinder 62, the hydraulic cylinder 62 retracts. The retraction of the hydraulic cylinder 62 causes movement of the lift actuator 62, which correspondingly causes the carriage assembly 34 to move downward relatively to the ground surface. In some embodiments, the downward movement of the carriage assembly 34 facilitated by gravity. It should be understood that the hydraulic cylinder 62 could alternatively be replaced by a pneumatic actuator, a motorized jackscrew, or an equivalent kind of actuator, all of which could be powered by the combustion engine 44. Further, it is considered within the scope of the present invention to use a double acting cylinder to move the carriage assembly 34.

Each lift 22 includes a control unit within the electrical control system that is configured to control activation of the lift's 22 hydraulic cylinder 62 and to communicate with the other control units of other lifts 22 by wireless signals to coordinate the raising and/or lifting of a vehicle. The control unit may include a controller or control processor, such as a microprocessor, microcontroller, field programmable gate array (FPGA), programmable logic controller (PLC), or the like, which is programmed to perform desired control and communication tasks. The control unit may also include a wireless transceiver, such as a radio frequency (RF) transceiver, which can be mounted as part of the control unit. The wireless transceiver may be associated with the externally mounted antenna 50 to radiate RF signals to transceivers in other control units and to receive signals therefrom. The alternator 66 and/or the rechargeable battery 68 provide electrical power to the components within the control unit through a power switch. As previously described, the battery 68 can be charged by the alternator 66, which is itself powered by the combustion engine 44. The transceiver includes circuitry which provides for operation on one of a plurality of RF channels which can be selected by the operator in the field, as will be described in more detail below.

The control unit may be interfaced with a number of components, designated as input components. One input component is a height sensor (i.e., a position sensor), which is configured to determine the height of the carriage 34 relative to the ground surface and to relay such information to the control unit. The height sensor is preferably a relative position sensor, such as one which employs an optical detector of spaced openings, markings, or the like. Such an optical detector (not shown) could be used with either a rotary or a linear set of markings. Alternatively, other types of height sensors could be employed, such as an electronic limit switch system, an electromechanical height sensor, and/or an electronic level. Examples of suitable electromechanical height sensors include distance sensing laser emitting devices and string potentiometers. In certain embodiments, the height sensor may be directly coupled to the lift 22. In other embodiments, the height sensor may not be directly coupled to the lift 22, but can be attached to the vehicle being lifted by the lift system 20. When an electronic level is used, such a level can include an accelerometer and can be configured for attachment to the vehicle being lifted by the lift system 20

Other input components include the emergency-stop switch 58, an interlock function switch, a mode selector switch, an up/down motion switch, and a communication channel selector switch. The emergency-stop switch 58, as previously described, enables an operator to instruct the control unit to stop movement of the carriage assembly 34. For safety, the interlock function switch is required to be engaged before lifting or lowering operations of the carriage assembly 34 can occur. When the lift system 20 is in a synchronized mode for coordinated lifting with other lifts 22, the interlock function also allows an operator to specify which one of the control units of the lifts 22 will be a master control unit. Once a master control unit is selected, the remaining control units are designated as slave control units and operate under user control actions initiated at the master control unit. A more detailed discussion of the coordinated operation of the lifts 22 will be provided below.

The mode selector switch allows the control unit to be toggled between an off mode and a synchronized mode. The motion switch selects the direction of movement and causes the control unit to initiate raising or lowering of the carriage assembly 34 relative to the ground surface. The emergency-stop, interlock, and/or or motion input components described above may alternatively be activated remotely via the user interface 24 that is removable and that includes wireless communications link. The channel selector switch enables the operator to select which RF channel the lift system 20 will use to communicate among the individual lifts 22. It should be appreciated that it is within the scope of the present invention to provide for other input devices such as, but not limited to, a level sensor (not shown) adapted to determine the orientation of a lift 22. In some embodiments, the control unit of the lifts 22 may also interface with a weight sensing mechanism configured to detect a weight supported by the carriage assembly 34 during lifting operations. As such, the lifts 22 are operable to perform an auto-engage function whereby the lifts 22 may automatically stop the movement of the carriage assembly 34 when the weight sensing mechanism senses a weight being lifted that is above a predetermined maximum engagement weight.

In operation, one or more of the lifts 22 are first placed in a position to support a portion of a vehicle. The synchronized mode of operation allows input commands at one control unit to influence other control units within the system to provide a coordinated lift of the vehicle. Coordination of the lifting operation is required to maintain the lifted vehicle in a substantially level orientation, that is, to avoid tipping the vehicle or other load. Initially, each control unit is set to a selected RF channel, using the channel selector switch. The control unit on one of the lifts 22 is turned on and proceeds to perform steps where the height is checked and displayed. Next, the mode selector switch is set to the synchronized mode position, if it is not already in such a position. Thereafter, a determination is made as to which of control units will take part in the coordinated lift of the vehicle. Preferably, the number of lifts 22 to be used is entered into the master control unit. At this point all participating control units should be set to the same RF channel. Next, any other lifts 22 that will take part in the lift should be set up. Set-up includes turning the lift 22 on (i.e., by starting the combustion engine 44) and setting the control unit to the same channel as the other lifts 22. If no other control units are turned on, then lift 22 scans for the selected RF channel and signals the height. In addition, the control unit may display its height as the operator sets up the other participating lifts 22. Once a control unit is placed in synchronized mode, it searches to communicate with one or more lifts 22 at the selected RF channel.

Once the other control units have been turned on, the control units of each of the lifts 22 are communicating at the same selected RF channel. Each of the height sensors provides a height measurement to its respective control unit, and the control units provide the height measurement on the display of the user interface 24. The control units search for other control units on the selected channel. If interference occurs or there is an unclear data exchange between the lifts 22, an error message or signal loss is shown on the display and the operator is prompted to reset the lift system 20 and select another RF channel. If this action occurs, the operator must turn off the lifts 22 and start the process from the beginning by selecting a different RF channel. This process may be repeated until a clear channel is located.

However, if no interference occurs, each of the control units waits for a command from its own unit's user interface 24 or from a control unit of one or the other lifts 22 by wireless communication. As previously discussed, the first control unit which is activated is designated as the master control unit, and the remaining control units are designated as slave control units. If none of the control units receive a command, then the master control unit may be established by selecting the interlock function on any one of the control units. If the interlock function is not selected, then each of the lifts 22 waits for a command. If the interlock is selected, then the operator chooses to raise or lower the vehicle at the master control unit. The master control unit proceeds to command the slave control units to raise or lower by one or more wireless signals of the up/down motion switch, and waits for a response from each of the slave control units. Once the wireless signals are sent via the selected RF channel by the master control unit, the slave control units wait to receive a command. If one or more of the slave units do not receive the wireless signal from the master control unit, the slave control unit retains its lift's 22 carriage assembly 34 at its current height.

However, if the slave control units receive wireless signal from the master control unit, then the slave control units must determine whether to raise, lower or hold the vehicle. If the wireless signal provides an instruction to raise the vehicle, the master control unit and each of the slave control units activate is respective pump valve and holding valve to cause the hydraulic cylinder 62 so as to move the vehicle in an upward direction. If the wireless signal provides an instruction to lower the vehicle, the master control unit and each of the slave control units activates its respective lowering valve so as to cause the hydraulic cylinder 62 to move the vehicle downwardly. The pump valve/holding valves and the lowering valves are preferably activated in intervals when the lifts 22 are raising and lowering the vehicle from the ground surface, respectively. However, it should be understood and appreciated that the intervals may be of such a short duration that the lifts 22 operate to smoothly raise or lower the vehicle relative to the surface. The operation of the pump valve/holding valves and lowering valves may alternatively be conducted in a substantially continuous manner without any apparent intervals.

Notwithstanding whether the vehicle is being raised or lowered as described above, the height sensors on each lift 22 determine the height of the carriage assembly 34 relative to the ground surface and convey such height information to their respective control units. The control units provide such height information to be presented on the display of the user interface 24 and then wait for further commands. The slave control units may send their respective height information by wireless signals to the master control unit. The master control unit compares its lift's 22 height information with the height information sent by the slave control units (i.e., corresponding to the other lifts 22 in the lift system 20) during the lifting or lowering of the vehicle and determines if an adjustment is needed. If the heights of each of the lifts 22 are within a predetermined tolerance range, the master control unit sends a signal to all of the other lifts' 22 slave control units to continue to lift or lower the vehicle. Once the vehicle has reaches a desired height, the slave control units wait for a further command. Alternatively, if the master control units receives a signal that indicates that one or more of the other lifts 22 are not at the proper height and an adjustment is needed, the master control unit will determine the rate of speed at which the lifts 22 must operate in order to maintain synchronism or coordination in the lift of the vehicle. For example, the master control unit may instruct the slow lifts 22 to catch up by transmitting such instructions via one or more wireless signals.

Once the lifts 22 have facilitated a lift operation, embodiments of the present invention may require that each combustion engine 44 of the lifts 22 run for a given amount of time until a lowering operation can be carried out. Such may be required so as to ensure that the battery 68 of the lift 22 has been fully recharged after the lift operation. As such, the combustion engine 44 will run for the given amount of time and the alternator 66 will correspondingly run so as to re-charge the battery 68. Such functionality prevents short cycles that will pull more charge from the battery 68 during a starting and lifting operations than will be put back into the battery 68 during such starting and lifting operations.

The above described process for coordinating the lifts 22 of a lift system 20 provides an exemplary method of coordinating and/or synchronizing the lifts 22 using wireless links between the lifts 22. Other methods for coordinating multiple lifts 22 using controllers interconnected by cables are known within the art, such as in U.S. Pat. No. 4,777,798, which is incorporated herein by reference.

Although the invention has been described with reference to the preferred embodiment illustrated in the attached drawing figures, it is noted that equivalents may be employed and substitutions made herein without departing from the scope of the invention as recited in the claims.

What is claimed is:

1. A combustion-powered portable vehicle lift comprising:

a base, a post supported by said base, a carriage assembly vertically shiftable relative to said post, a combustion power system comprising a propane tank and a propane engine; and a hydraulic power system comprising a hydraulic reservoir, a hydraulic pump, and a hydraulic cylinder, wherein said combustion power system is operable to power the hydraulic power system to shift the carriage assembly relative to the post.

2. The vehicle lift of claim 1, wherein said combustion power system provides rotary motion to the hydraulic pump of the hydraulic power system for generating hydraulic power.

3. The vehicle lift of claim 1, further including an electrical control system comprising an electrical generation unit and an electrical storage device.

4. The vehicle lift of claim 3, wherein said combustion power system provides rotary motion to the electrical generation unit of the electrical control system for generating electrical power.

5. The vehicle lift of claim 4, wherein the electrical generation unit is an alternator and the electrical storage device is a battery, and wherein the alternator is configured to provide a recharging current to the battery.

6. The vehicle lift of claim 1, wherein the combustion power system additional includes one or more of the following: fuel lines, pressure regulators, and velocity fuses.

7. The vehicle lift of claim 1, wherein said hydraulic power system further one or more hydraulic valves selected from one or more of the following: a pump valve, a lowering valve, and a holding valve.

8. A combustion-powered portable vehicle lift comprising:

a base, a post supported by said base, a carriage assembly vertically shiftable relative to said post, a combustion power system comprising a fuel tank and a combustion engine; and a hydraulic power system comprising a hydraulic reservoir, a hydraulic pump, and a hydraulic cylinder, wherein said combustion power system is operable to power the hydraulic power system to shift the carriage assembly relative to the post, further including an electrical control system comprising an electrical generation unit and an electrical storage device, wherein the electrical control system further comprises a pressure sensor for sensing a fuel level in the fuel tank and a voltage sensor for measuring a voltage of the electrical storage device.

9. A combustion-powered portable vehicle lift comprising:

a base, a post supported by said base, a carriage assembly vertically shiftable relative to said post, a combustion power system comprising a fuel tank and a combustion engine; and a hydraulic power system comprising a hydraulic reservoir, a hydraulic pump, and a hydraulic cylinder, wherein said combustion power system is operable to power the hydraulic power system to shift the carriage assembly relative to the post, further including an electrical control system comprising an electrical generation unit and an electrical storage device, wherein the electrical control system further comprises an electrical outlet for providing electrical power to one or more external tools, and wherein the electrical outlet receives electrical power from the electrical generation unit.

10. A combustion-powered portable vehicle lift comprising:

a base, a post supported by said base, a carriage assembly vertically shiftable relative to said post, a combustion power system comprising a fuel tank and a combustion engine; and a hydraulic power system comprising a hydraulic reservoir, a hydraulic pump, and a hydraulic cylinder, wherein said combustion power system is operable to power the hydraulic power system to shift the carriage assembly relative to the post, further comprising an air compressor associated with the vehicle lift, and wherein the air compressor receives power from the combustion power system.

11. A portable vehicle lift system comprising:

two or more portable lifts, each comprising a base, a post, and a carriage assembly, wherein each of the portable lifts further includes a combustion power system comprising a propane tank and a propane engine, and a hydraulic power system comprising a hydraulic reservoir, a hydraulic pump, and a hydraulic cylinder, wherein said combustion power system is operable to provide power to the hydraulic power system to shift the carriage assembly relative to the post.

12. The lift system of claim 11, wherein each portable lift further includes an electrical control system comprising an electrical generation unit and an electrical storage device.

13. The lift system of claim 12, wherein said combustion power system provides rotary motion to the electrical generation unit of the control system for generating electrical power.

14. The lift system of claim 13, wherein the electrical generation unit is an alternator and the electrical storage device is a battery, and wherein the alternator is configured to provide a recharging current to the battery.

15. A portable vehicle lift system comprising:

two or more portable lifts, each comprising a base, a post, and a carriage assembly, wherein each of the portable lifts further includes a combustion power system comprising a fuel tank and a combustion engine, and a hydraulic power system comprising a hydraulic reservoir, a hydraulic pump, and a hydraulic cylinder, wherein said combustion power system is operable to provide power to the hydraulic power system to shift the carriage assembly relative to the post, wherein each portable lift further includes an electrical control system comprising an electrical generation unit and an electrical storage device, wherein each of the electrical control systems further includes a wireless communications device, such that each of the portable lifts are configured to be in wireless communication with each other.

16. The lift system of claim 11, wherein the propane tanks of the lifts are dedicated propane tanks, and wherein the lift system further includes at least one replacement propane tank for replacing at least one of the dedicated propane tanks.

17. A method of using a combustion-powered portable vehicle lift system to raise a vehicle, said method comprising the steps of:

providing two or more portable lifts, each comprising a carriage assembly configured to engage and support a wheel of the vehicle, a hydraulic power system with a hydraulic cylinder configured to vertically shift said carriage assembly, a combustion power system comprising a propane tank and a propane engine for powering said hydraulic power system, and an electrical control system configured to control said portable lifts;

providing an instruction to the lift system to raise the vehicle;

determining whether each propane engine associated with each of said two or more portable lifts is running;

upon determining that each propane engine is running, raising the vehicle with the portable lifts of the lift system; and upon determining that each propane engine is not running, not raising the vehicle.

18. The method of claim 17, further including the step of: upon raising the vehicle, providing an instruction for each of the propane engines associated with each of said two or more portable lifts to continue running for a time period to recharge a battery associated with the electrical control system.

* * * * *